US011946321B2

(12) United States Patent
Schroder

(10) Patent No.: US 11,946,321 B2
(45) Date of Patent: Apr. 2, 2024

(54) CUTTING ELEMENT ASSEMBLIES AND DOWNHOLE TOOLS COMPRISING ROTATABLE AND REMOVABLE CUTTING ELEMENTS AND RELATED METHODS

(71) Applicant: Baker Hughes Oilfield Operations LLC, Houston, TX (US)

(72) Inventor: Jon David Schroder, The Woodlands, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/817,533

(22) Filed: Aug. 4, 2022

(65) Prior Publication Data

US 2024/0044214 A1 Feb. 8, 2024

(51) Int. Cl.

| | |
|---|---|
| ***E21B 10/573*** | (2006.01) |
| ***E21B 7/04*** | (2006.01) |
| ***E21B 10/43*** | (2006.01) |

(52) U.S. Cl.

CPC ..... *E21B 10/573* (2013.01); *E21B 7/046* (2013.01); *E21B 10/43* (2013.01)

(58) Field of Classification Search

CPC ..... E21B 10/573; E21B 7/046; E21B 10/43; E21B 10/633

See application file for complete search history.

(56) References Cited

U.S. PATENT DOCUMENTS

| | | | |
|---|---|---|---|
| 7,942,218 | B2 | 5/2011 | Cooley et al. |
| 8,794,356 | B2 | 8/2014 | Lyons et al. |
| 9,279,294 | B1 | 3/2016 | Cooley et al. |

(Continued)

FOREIGN PATENT DOCUMENTS

| | | | |
|---|---|---|---|
| RU | 2592911 | C1 | 7/2016 |
| WO | 2016/081807 | A1 | 5/2016 |

OTHER PUBLICATIONS

Abdel-Aal et al., Development and Field Testing of a Novel Multifunctional Drilling Enhancement Tool in a Middle East Field, Paper presented at the International Petroleum Technology Conference, Dhahran, Kingdom of Saudi Arabia, Jan. 2020, 2 pages.

(Continued)

*Primary Examiner* — Tara Schimpf
*Assistant Examiner* — Jennifer A Railey
(74) *Attorney, Agent, or Firm* — TraskBritt

(57) ABSTRACT

A cutting element assembly includes a cutting element and a sleeve having a cutter-receiving aperture configured to receive at least a portion of the cutting element within the cutter-receiving aperture. The cutting element assembly may also include a retention element rotatably coupling the cutting element to the sleeve and a biasing member disposed between the cutting element and the sleeve. The biasing member may be configured to bias the cutting element relative to the sleeve. A method of forming a downhole tool includes forming a bit body including at least one blade, securing at least one sleeve to the blade, disposing at least one biasing member within the cutter-receiving aperture, and inserting a cutting element into the cutter-receiving aperture of the at least one sleeve, such that the at least one biasing member is disposed between the at least one sleeve and the cutting element.

19 Claims, 9 Drawing Sheets

(56) References Cited

U.S. PATENT DOCUMENTS

| | | | | |
|---|---|---|---|---|
| 9,605,486 | B2 * | 3/2017 | Burhan | E21B 10/42 |
| 10,119,341 | B2 * | 11/2018 | Zhang | E21B 10/573 |
| 2012/0273281 | A1 * | 11/2012 | Burhan | E21B 10/573 175/431 |
| 2013/0333953 | A1 * | 12/2013 | Zhang | E21B 10/5735 175/428 |
| 2015/0152688 | A1 | 6/2015 | Cooley et al. | |
| 2017/0191317 | A1 | 7/2017 | Burhan et al. | |
| 2018/0010396 | A1 | 1/2018 | Dunbar et al. | |
| 2019/0078393 | A1 * | 3/2019 | Moss, Jr. | E21B 10/55 |
| 2020/0181986 | A1 * | 6/2020 | Schroder | E21B 10/08 |
| 2021/0079732 | A1 | 3/2021 | Grosz | |

OTHER PUBLICATIONS

International Search Report for Application No. PCT/US2023/070378 dated Nov. 20, 2023, 4 pages.

International Written Opinion for Application No. PCT/US2023/070378 dated Nov. 20, 2023, 5 pages.

* cited by examiner

700

800

900

CUTTING ELEMENT ASSEMBLIES AND DOWNHOLE TOOLS COMPRISING ROTATABLE AND REMOVABLE CUTTING ELEMENTS AND RELATED METHODS

FIELD

Embodiments of the present disclosure relate generally to removable cutting elements and earth-boring tools having such cutting elements, as well as related methods of forming downhole tools.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit, such as an earth-boring rotary drill bit. Different types of earth-boring rotary drill bits are known in the art, including fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may include, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

A drill string may include a number of components in addition to a downhole motor and drill bit including, without limitation, drill pipe, drill collars, stabilizers, measuring while drilling (MWD) equipment, logging while drilling (LWD) equipment, downhole communication modules, and other components.

In addition to drill strings, other tool strings may be disposed in an existing well bore for, among other operations, completing, testing, stimulating, producing, and remediating hydrocarbon-bearing formations.

Cutting elements used in earth boring tools often include polycrystalline diamond compact (often referred to as "PDC") cutting elements, which are cutting elements that include so-called "tables" of a polycrystalline diamond material mounted to supporting substrates and presenting a cutting face for engaging a subterranean formation. Polycrystalline diamond (often referred to as "PCD") material is material that includes inter-bonded grains or crystals of diamond material. In other words, PCD material includes direct, intergranular bonds between the grains or crystals of diamond material.

Cutting elements are typically mounted on body a drill bit by brazing. The drill bit body is formed with recesses therein, commonly termed "pockets," for receiving a substantial portion of each cutting element in a manner which presents the PCD layer at an appropriate back rake and side rake angle, facing in the direction of intended bit rotation, for cutting in accordance with the drill bit design. In such cases, a brazing compound is applied between the surface of the substrate of the cutting element and the surface of the recess on the bit body in which the cutting element is received. The cutting elements are installed in their respective recesses in the bit body, and heat is applied to each cutting element via a torch to raise the temperature to a point high enough to braze the cutting elements to the bit body in a fixed position but not so high as to damage the PCD layer.

Unfortunately, securing a PDC cutting element to a drill bit in a conventional manner as described above restricts the useful life of such cutting element, because the cutting edge of the diamond table and the substrate wear down, creating a so-called "wear flat" and necessitating increased weight-on-bit to maintain a given rate of penetration of the drill bit into the formation due to the increased surface area presented. In addition, unless the cutting element is heated to remove it from the bit and then rotated to be re-brazed with an unworn portion of the cutting edge presented for engaging a formation, more than half of the cutting element is never used or alternatively the cutting elements on a drill bit must be moved to an alternative interlocking position manually in order to present an unworn portion of the cutting edge.

DETAILED DESCRIPTION

Figure 1:
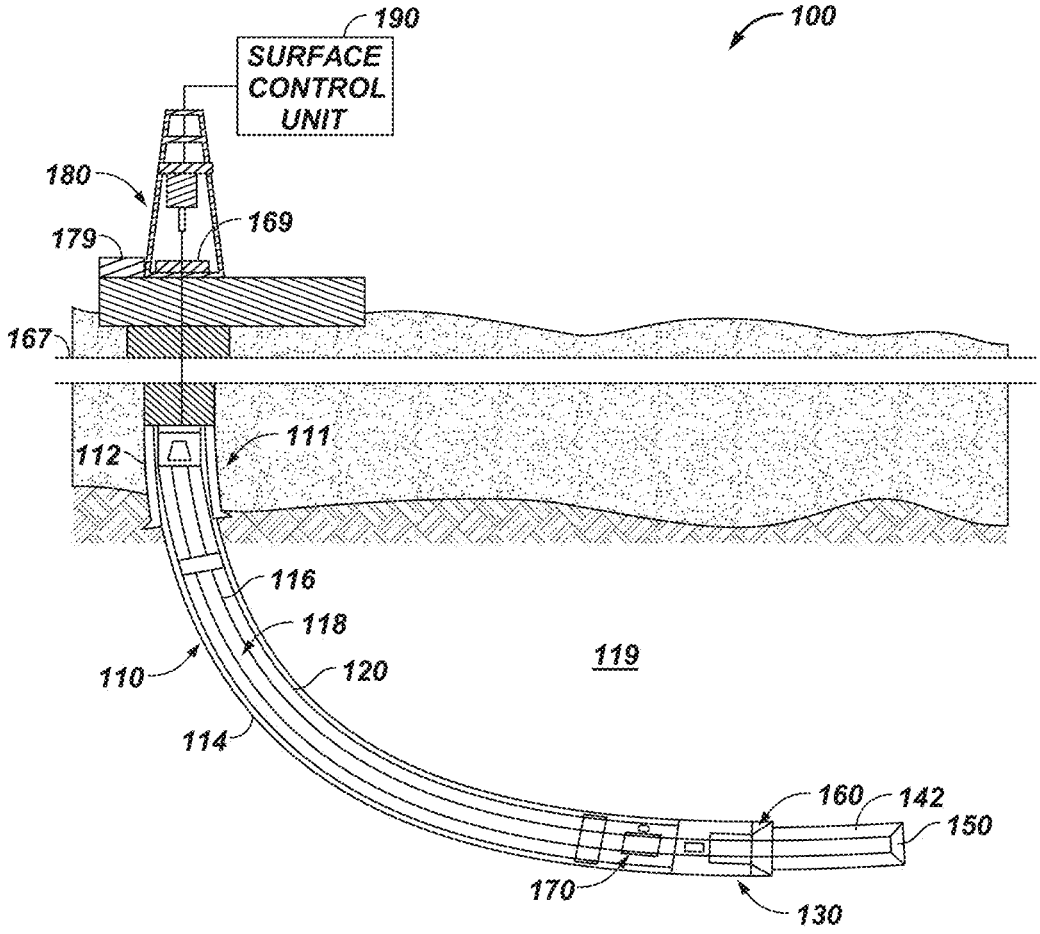
FIG. 1 is a simplified schematic diagram of an example of a drilling system using cutting element assemblies according to one or more embodiments of the present disclosure.

The illustrations presented herein are not actual views of any particular cutting assembly, tool, or drill string, but are merely idealized representations employed to describe example embodiments of the present disclosure. The following description provides specific details of embodiments of the present disclosure in order to provide a thorough description thereof. However, a person of ordinary skill in the art will understand that the embodiments of the disclosure may be practiced without employing many such specific details. Indeed, the embodiments of the disclosure may be practiced in conjunction with conventional techniques employed in the industry. In addition, the description provided below does not include all elements to form a complete structure or assembly. Only those process acts and structures necessary to understand the embodiments of the disclosure are described in detail below. Additional conventional acts and structures may be used. Also note, any drawings accompanying the application are for illustrative purposes only, and are thus not drawn to scale. Additionally, elements common between figures may have corresponding numerical designations.

As used herein, the terms "comprising," "including," "containing," "characterized by," and grammatical equivalents thereof are inclusive or open-ended terms that do not exclude additional, un-recited elements or method steps, but also include the more restrictive terms "consisting of," "consisting essentially of," and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, spatially relative terms, such as "below," "lower," "bottom," "above," "upper," "top," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter).

As used herein, the term "hard material" means and includes any material having a Knoop hardness value of about 1,000 kgr/mm$^2$ (9,807 MPa) or more. Hard materials include, for example, diamond, cubic boron nitride, boron carbide, tungsten carbide, etc.

As used herein, the term "intergranular bond" means and includes any direct atomic bond (e.g., covalent, metallic, etc.) between atoms in adjacent grains of material.

As used herein, the term "polycrystalline hard material" means and includes any material comprising a plurality of grains or crystals of the material that are bonded directly together by intergranular bonds. The crystal structures of the individual grains of polycrystalline hard material may be randomly oriented in space within the polycrystalline hard material.

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

FIG. 1 is a schematic diagram of an example of a drilling system 100 using cutting element assemblies disclosed herein. FIG. 1 shows a wellbore 110 that may include an upper section 111 with a casing 112 installed therein and a lower section 114 that is being drilled with a drill string 118. The drill string 118 may include a tubular member 116 that carries a drilling assembly 130 at its bottom end. The tubular member 116 may be coiled tubing or may be formed by joining drill pipe sections. A drill bit 150 (also referred to as the "pilot bit") may be attached to the bottom end of the drilling assembly 130 for drilling a first, smaller diameter borehole 142 in the formation 119. A reamer bit 160 may be placed above or uphole of the drill bit 150 in the drill string to enlarge the borehole 142 to a second, larger diameter borehole 120. The terms wellbore and borehole are used herein as synonyms.

The drill string 118 may extend to a rig 180 at the surface 167. The rig 180 shown is a land rig for ease of explanation. The apparatus and methods disclosed herein equally apply when an offshore rig is used for drilling underwater. A rotary table 169 or a top drive may rotate the drill string 118 and the drilling assembly 130, and thus the pilot bit 150 and reamer bit 160, to respectively form boreholes 142 and 120. The rig 180 may also include conventional devices, such as mechanisms to add additional sections to the tubular member 116 as the wellbore 110 is drilled. A surface control unit 190, which may be a computer-based unit, may be placed at the surface for receiving and processing downhole data transmitted by the drilling assembly 130 and for controlling the operations of the various devices and sensors 170 in the drilling assembly 130. A drilling fluid from a source 179 thereof is pumped under pressure through the tubular member 116 that discharges at the bottom of the pilot bit 150 and returns to the surface via the annular space (also referred to as the "annulus") between the drill string 118 and an inside wall of the wellbore 110.

During operation, when the drill string 118 is rotated, both the pilot bit 150 and the reamer bit 160 may rotate. The pilot bit 150 drills the first, smaller diameter borehole 142, while simultaneously the reamer bit 160 enlarges the borehole 142 to a second, larger diameter borehole 120. The earth's subsurface formation may contain rock strata made up of different rock structures that can vary from soft formations to very hard formations, and therefore the pilot bit 150 and/or the reamer bit 160 may be selected based on the formations expected to be encountered in a drilling operation.

Figure 2:
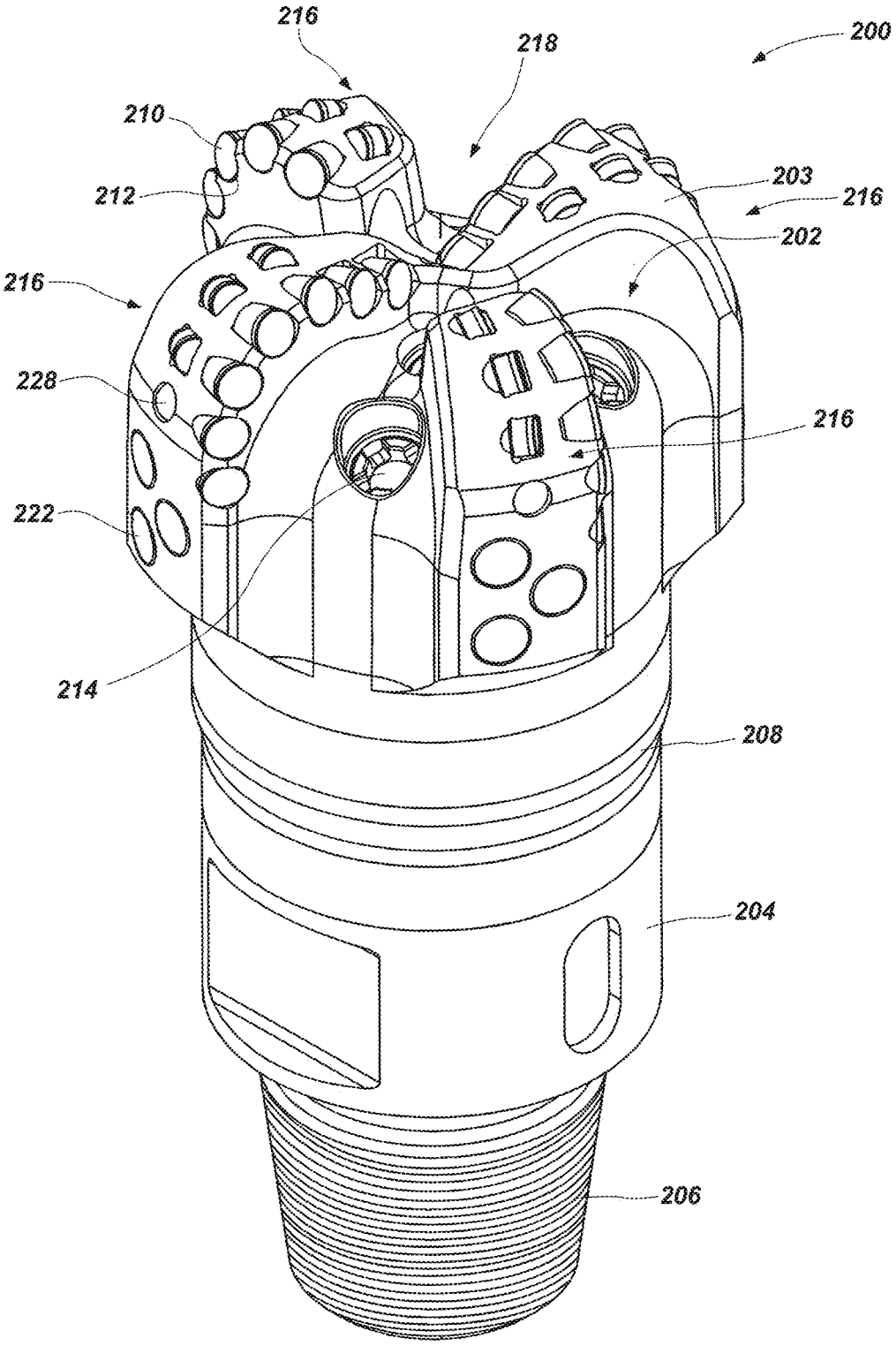
FIG. 2 is a simplified perspective view of a fixed-blade earth-boring rotary drill bit that may be used in conjunction with the drilling system of FIG. 1.

FIG. 2 is a perspective view of a fixed-cutter earth-boring rotary drill bit 200 that may be used in conjunction with the drilling system 100 of FIG. 1. For example, the drill bit 200 may be the pilot bit 150 shown in FIG. 1. The drill bit 200 includes a bit body 202 that may be secured to a shank 204 having a threaded connection portion 206 (e.g., an American Petroleum Institute (API) threaded connection portion) for attaching the drill bit 200 to a drill string (e.g., drill string 118, shown in FIG. 1). In some embodiments, the bit body 202 may be secured to the shank 204 using an extension 208. In other embodiments, the bit body 202 may be secured directly to the shank 204.

The bit body 202 may include internal fluid passageways that extend between the face 203 of the bit body 202 and a longitudinal bore, extending through the shank 204, the extension 208, and partially through the bit body 202. Nozzle inserts 214 also may be provided at the face 203 of the bit body 202 within the internal fluid passageways. The bit body 202 may further include a plurality of blades 216 that are separated by junk slots 218. In some embodiments, the bit body 202 may include gage wear plugs 222 and wear knots 228. A plurality of cutting element assemblies 210 may be mounted on the face 203 of the bit body 202 in cutting element pockets 212 that are located along each of the blades 216. The cutting element assemblies 210 may include PDC cutting elements, or may include other cutting elements. For example, some or all of the cutting element assemblies 210 may include rotatable cutting elements, as described below and shown in FIGS. 3A-5C.

Figure 3:
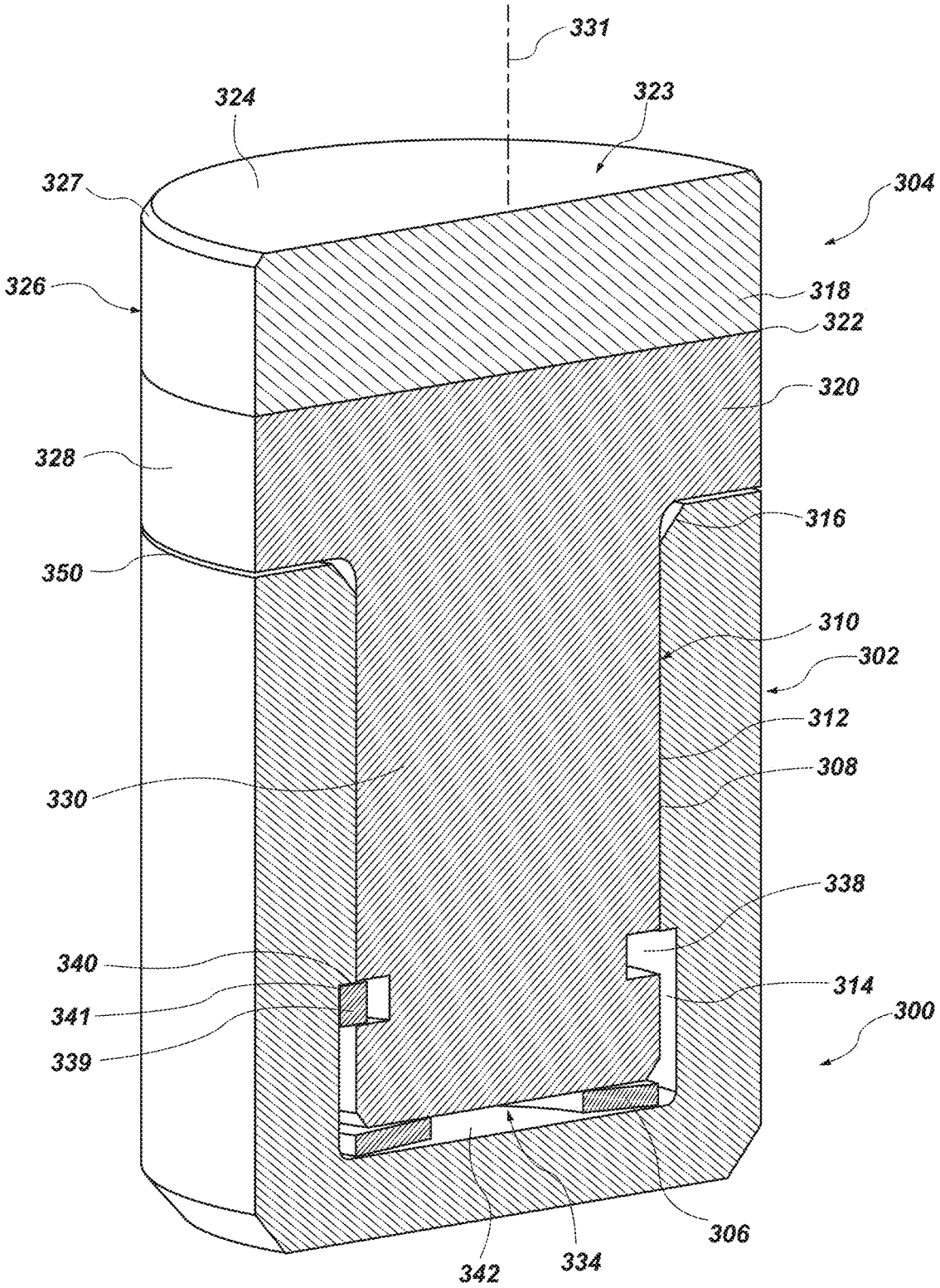
FIG. 3 is a perspective cross-sectional view of a cutting element assembly according to one or more embodiments of the present disclosure.
Figure 4:
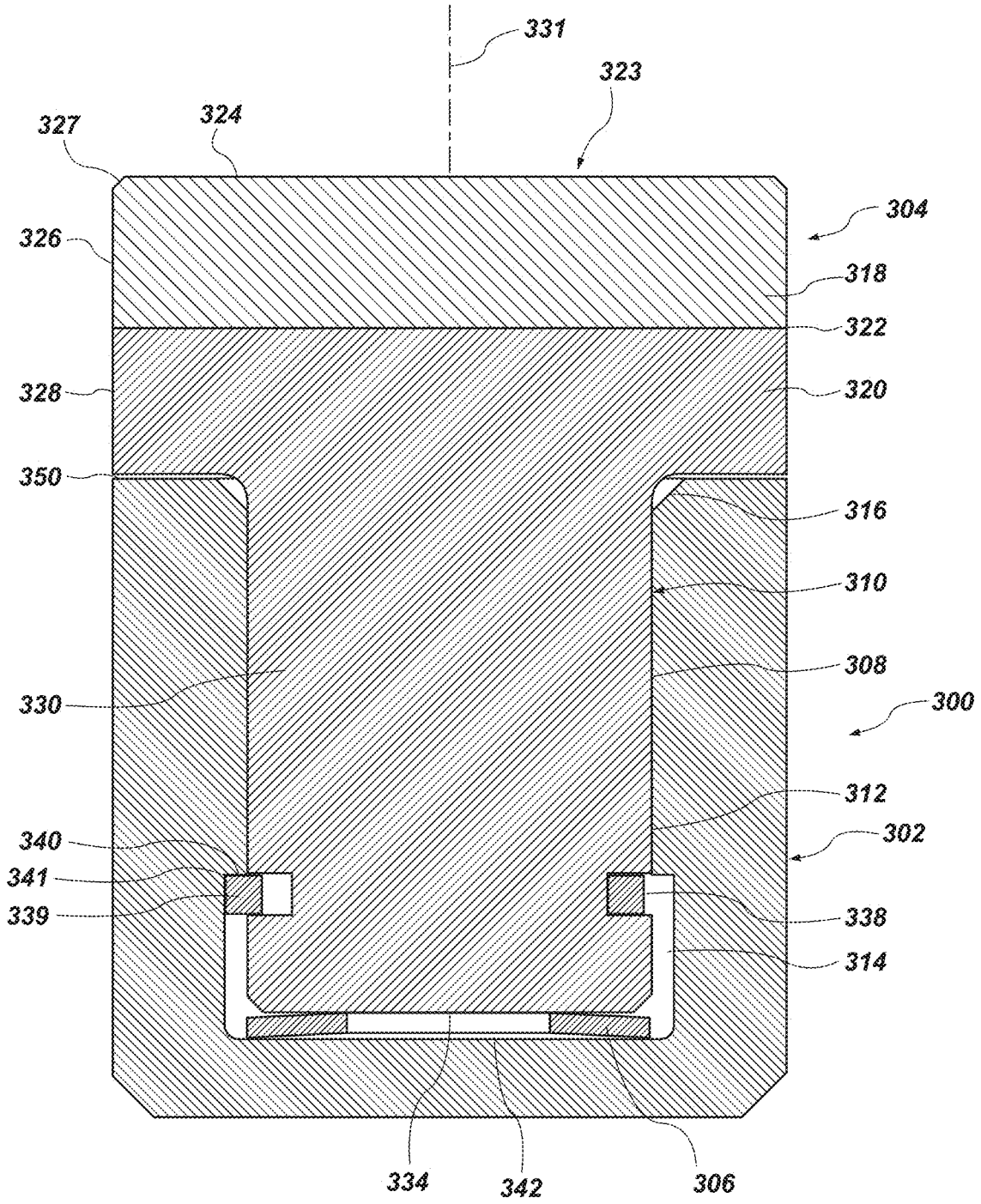
FIG. 4 is a perspective cross-sectional view of a cutting element assembly according to one or more embodiments of the present disclosure.

FIG. 3 is a perspective cross-sectional view of a cutting element assembly 300 having a rotatable and removable cutting element 304 (referred to herein as "cutting element"), a biasing member 306, and a sleeve 302. FIG. 4 is another perspective cross-sectional view of the cutting element assembly 300. Referring to FIGS. 3 and 4 together, the cutting element 304 may be at least partially disposed (e.g., inserted) within the sleeve 302, and the biasing member 306 may be disposed between the sleeve 302 and the cutting element 304. As is described in greater detail below, the biasing member 306 may bias a position of the cutting element 304 relative to a position of the sleeve 302.

The cutting element assembly 300 may be mountable to a body portion, such as a blade, of an earth-boring tool. For example, the cutting element assembly 300 may be inserted into a cutting element pocket of the blade. The blade may be, for example, one of the blades 216 shown in FIG. 2, and the cutting element assembly 300 may be one of the cutting element assemblies 210 shown in FIG. 2. As is described in greater detail below, the cutting element 304 may be removable from and rotatable within the sleeve 302 when the sleeve 302 is secured to the body portion of the earth-boring tool, without utilizing heat. As a result, the cutting element 304 herein may be relatively easily removed and replaced, such as when the cutting element 304 is worn or damaged.

With continued reference to FIGS. 3 and 4, as mentioned above, the sleeve 302 may be secured to the blade. For example, the sleeve 302 may be brazed or welded within a pocket of the blade. In other embodiments, the sleeve 302 may be integrally formed with the blade, such that there may be no physical interface between the sleeve 302 and the blade. In other words, the blade may be formed to include the features of the sleeve 302. Further, the sleeve 302 may comprise a preformed component that is secured to the blade during formation of the blade and body from which the blade may protrude, by insertion of the sleeve 302 into a mold cavity wherein the body and blade are formed as by infiltration of matrix material, or by casting.

The rotatable cutting element 304 may include a polycrystalline hard material 318 bonded to a substrate 320 at an interface 322. In other embodiments, the rotatable cutting element 304 may be formed entirely of the polycrystalline hard material 318, or may have another material in addition to the polycrystalline hard material 318 and the substrate 320. The polycrystalline hard material 318 may include diamond, cubic boron nitride, or another hard material, for example. The substrate 320 may include, for example, cobalt-cemented tungsten carbide or another carbide material.

The polycrystalline hard material 318 may have an end cutting surface 324, and may also have other surfaces, such as a side surface 326, a chamfer 327, etc., which surfaces may be cutting surfaces intended to contact a subterranean formation. The polycrystalline hard material 318 may be generally cylindrical, and the interface 322 may be generally parallel to the end cutting surface 324.

The substrate 320 may have a first generally cylindrical portion 328 and a second generally cylindrical portion 330. The first generally cylindrical portion 328 may share a center longitudinal axis 331 with the second generally cylindrical portion 330. In some embodiments, the second generally cylindrical portion 330 may have a smaller outer diameter than the first generally cylindrical portion 328. Additionally, in one or more embodiments, the first generally cylindrical portion 328 may have an outer diameter that is at least substantially the same as an outer diameter of the sleeve 302. The substrate 320 may have a back surface 334 at least substantially parallel to the end cutting surface 324 of the polycrystalline hard material 318 and/or to the interface 322 between the polycrystalline hard material 318 and the substrate 320. Although the substrate 320 of the cutting element 304 described herein has a planar cutting face of polycrystalline hard material 318 located thereon, the disclosure is not so limited. Rather, the cutting element 304 may include shaped cutting elements having dome shapes, conical shapes, pyramid shapes, or any other suitable shape of cutting face. As a non-limiting example, the cutting element 304 may include any of the cutting elements described in U.S. Pat. No. 8,794,356, to Lyons et al., issued Aug. 5, 2014, the disclosure of which is incorporated in its entirety by reference herein.

The second generally cylindrical portion 330 may further include a groove 338 extending radially inward from an outer surface of the second generally cylindrical portion 330. The groove 338 may extend circumferentially around an outer circumference of the second generally cylindrical portion 330. In some embodiments, the groove 338 may be substantially continuous around a whole circumference of the second generally cylindrical portion 330. In other embodiments, the groove 338 may extend around only a portion of the circumference of the second generally cylindrical portion 330. As is described in greater detail below, the groove 338 may be sized and shaped to receive a retention element 339.

The sleeve 302 may include a first generally cylindrical interior surface 308 defining a cutter-receiving aperture 310 extending partially through the sleeve 302. Additionally, the cutter-receiving aperture 310 may be sized and shaped to receive at least a portion of the cutting element 304. The cutter-receiving aperture 310 may further comprise a first portion 312 and a second portion 314. The first portion 312 of the cutter-receiving aperture 310 may extend from a longitudinal end 350 of the sleeve 302 and into the sleeve 302. The second portion 314 may be connected to the first portion 312 and may have a larger diameter than the first portion 312. Additionally, the second portion 314 may define a deeper or deepest portion of the cutter-receiving aperture 310. The second portion 314 may share a center longitudinal axis 331 with the first portion 312. In other words, the second portion 314 may be coaxial with the first portion 312 of the cutter-receiving aperture 310.

In some embodiments, the sleeve 302 may include a chamfer 316 at an interface of the longitudinal end 350 of the sleeve 302 and the first generally cylindrical interior surface 308. In some embodiments, the chamfer 316 provides clearance between the cutting element 304 and the sleeve 302.

The diameter of the second generally cylindrical portion 330 of the cutting element 304 may be smaller than the diameter of the first portion 312 of the cutter-receiving aperture 310. The diameter of the second generally cylindrical portion 330 of the cutting element 304 and the diameter of the first portion 312 may be sufficiently close (e.g., substantially equal) to allow the cutting element 304 to rotate freely relative to the sleeve 302 about the center longitudinal axis 331 and to translate in an axial direction relative to the sleeve 302 but substantially prevent translation of the cutting element 304 in directions orthogonal to the center longitudinal axis 331.

In some embodiments, the diameter of the cutter-receiving aperture 310 may be stepped and may increase when transitioning from the first portion 312 of the cutter-receiving aperture 310 to the second portion 314 of the cutter-receiving aperture 310. For example, the sleeve 302 may define an annular step 341 at the interface of the first portion 312 and the second portion 314 of the cutter-receiving aperture 310. The annular step 341 may define a retaining face 340. The retaining face 340 may face in a direction opposite the longitudinal end 350 of the sleeve 302 from which the cutter-receiving aperture 310 extends, and the retaining face 340 may lie within a plane to which the center longitudinal axis 331 is normal. The sleeve 302 may include an inner base surface 342 of the sleeve 302 defining a bottom of the cutter-receiving aperture 310 and defining an innermost portion (e.g., deepest) of the second portion 314 of the cutter-receiving aperture 310. In some embodiments, the inner base surface 342 may be substantially parallel to the retaining face 340.

Referring still to FIGS. 3 and 4, the cutting element assembly 300 may further include the retention element 339. When assembled, the retention element 339 may couple the cutting element 304 to the sleeve 302. The retention element 339 may extend partially and substantially circumferentially around the second generally cylindrical portion 330 of the cutting element 304 and within the groove 338 of the second generally cylindrical portion 330 of the cutting element 304. In some embodiments, the retention element 339 may include a split ring.

In operation, the retention element 339 may also be configured to be disposed within the groove 338 of the second generally cylindrical portion 330 of the cutting element 304 and extend radially outward into the second portion 314 of the cutter-receiving aperture 310. As a result, the retention element 339 may abut the retaining face 340 and may prevent the cutting element 304 from being removed from the sleeve 302 via mechanical interference.

The biasing member 306 may be disposed between the cutting element 304 and the sleeve 302 and configured to bias the cutting element 304 (e.g., a position of the cutting element 304) relative to the sleeve 302 in an axial direction. As used herein the term "axial direction" may refer to a direction along the center longitudinal axis 331 of the cutting element 304. The biasing member 306 may be disposed between a longitudinal end of the cutting element 304 opposite a cutting table 323 of the cutting element 304 and the inner base surface 342 of the sleeve 302 defining the bottom of the cutter-receiving aperture 310. In some embodiments, the biasing member 306 may include a spring. For example, the biasing member 306 may comprise at least one Belleville spring. In additional embodiments, the biasing member 306 may be disposed between other substantially parallel faces of the cutting element 304 and the sleeve 302. The geometry of the components of the cutting element assembly 300 may be altered to accommodate alternative biasing members or alternative retention elements. In one embodiment, the biasing member 306 may have an outer diameter no larger than the second generally cylindrical portion 330 of the cutting element 304. This allows for the biasing member to be easily placed within the second portion 314. In an additional embodiment, the biasing member 306 may have a larger diameter than the second generally cylindrical portion 330 of the cutting element 304. Additionally, the biasing member 306 may not be substantially cylindrical in appearance.

Figure 5:
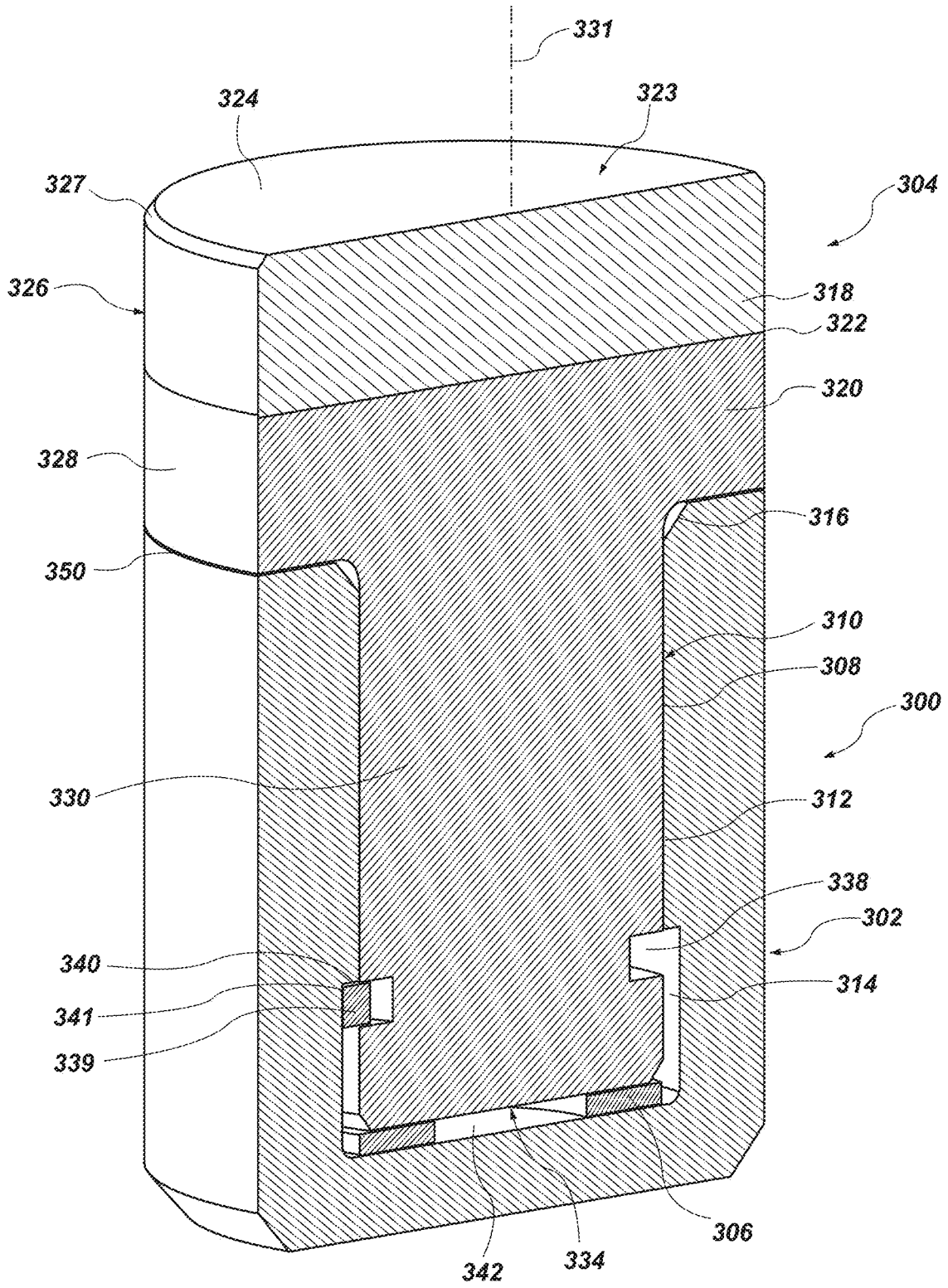
FIG. 5 is a perspective cross-sectional view of a cutting element assembly according to one or more embodiments of the present disclosure.
Figure 6:
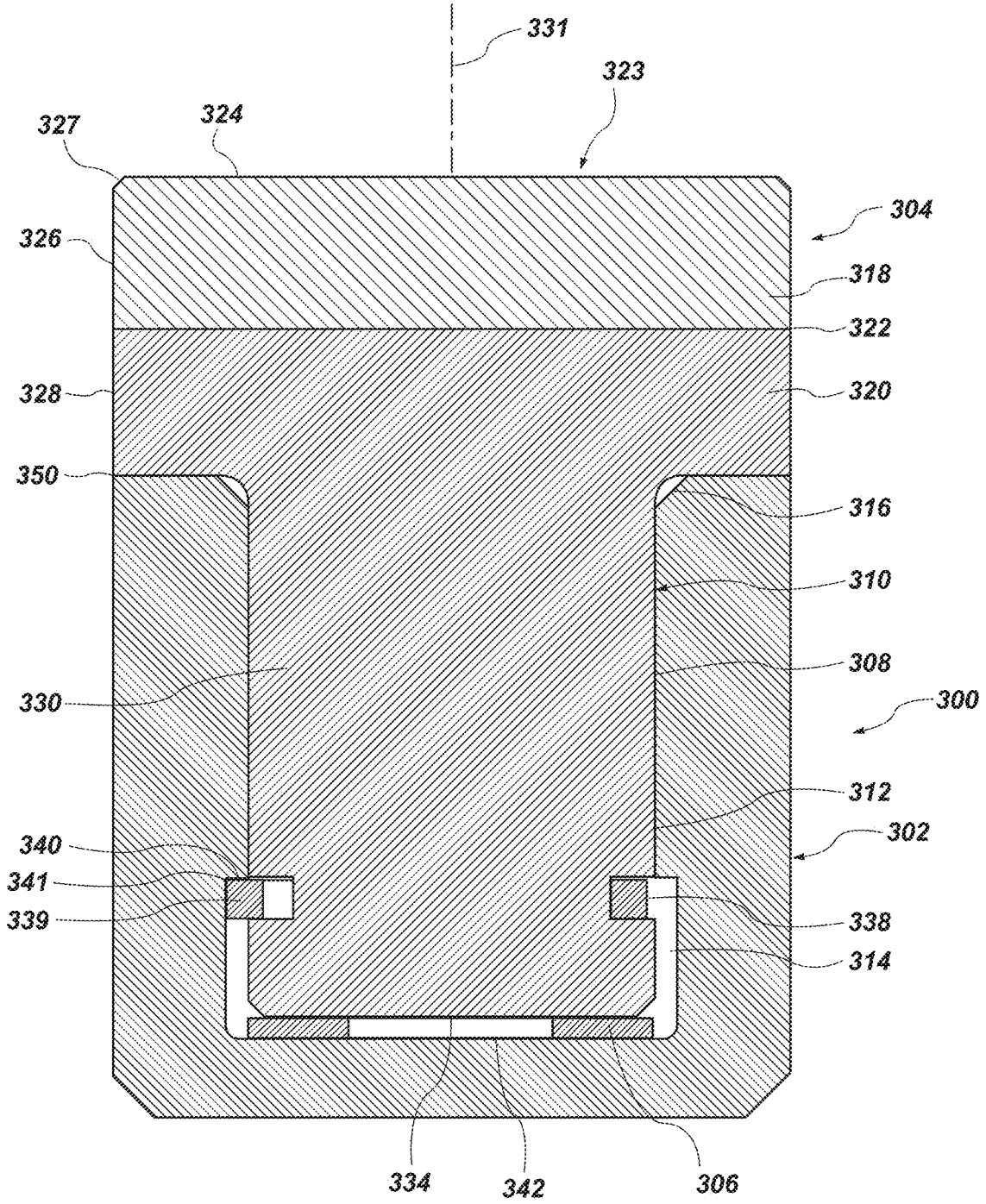
FIG. 6 is a perspective cross-sectional view of a cutting element assembly according to one or more embodiments of the present disclosure.

Referring to FIGS. 3 and 4, the cutting element assembly 300 is depicted in an extended orientation with the cutting element 304 in an extended position relative to the sleeve 302. For example, FIGS. 3 and 4 depict a state of the cutting element assembly 300 where the cutting element 304 has translated in the axial direction maximum distance away from the sleeve 302 due to the biasing member 306. Conversely, FIGS. 5 and 6 depict the cutting element assembly 300 in a compressed orientation with the cutting element 304 in a compressed position relative to the sleeve 302. For instance, FIGS. 5 and 6 depict a state of the cutting element assembly 300 where the cutting element 304 has translated in the axial direction a maximum distance into the sleeve 302 due to contact with a formation (e.g., external forces on the cutting element 304). In some embodiments, the cutting element 304 may be configured to translate in the axial direction relative to the sleeve 302 by a maximum distance within the range of about 0.001 to about 0.010 inch. For example, the cutting element 304 may be configured to translate in the axial direction relative to the sleeve 302 by 0.006 in. The biasing member 306 may be compressed by the longitudinal end of the cutting element 304 opposite the cutting table 323 until flush against the inner base surface 342. This compressed position may also result in the first cylindrical portion 328 abutting against a longitudinal end 350 of the sleeve 302.

During operation of the drilling system 100, the cutting table 323 of the cutting element 304 may contact a subterranean formation. When the cutting table 323 of the cutting element 304 contacts a subterranean formation or is subject to an external force, the biasing member 306 may be at least partially compressed and the cutting element 304 may be put into a compressed position relative to the sleeve 302. When the cutting table 323 is not in contact with the subterranean formation or subject to an external force, the biasing member 306 may cause the cutting element 304 to return to an extended position relative to the sleeve 302. This cycle of compression and extension of the cutting element assembly 300 may allow the cutting element 304 to rotate relative to the sleeve 302 at least some during each cycle. In some embodiments, the cutting element 304 may rotate about three times faster than a cutting element without a biasing member. In some embodiments, the ratio of rotations of the cutting element 304 relative to a cutting element without a biasing member may be higher or lower than three to one. As is described in greater detail below, the translation and rotation of the cutting element 304 allows for the end cutting surface 324, and other surfaces, such as the side surface 326, the chamfer 327, etc. of the cutting element 304 to contact a subterranean formation in a consistent and more uniform manner in comparison to conventional cutting element assemblies. As a result, the cutting element 304 may experience a more uniform wear around the end cutting surface 324, and other surfaces, such as the side surface 326, the chamfer 327, etc. of the cutting element 304 in comparison to conventional cutting elements. The consistent and uniform wear about the end cutting surface 324, and other surfaces, such as the side surface 326, the chamfer 327, etc. of the cutting element 304 may increase a life span of the cutting element 304 by about 700%.

In one or more embodiments, the biasing member 306 may include a plurality of biasing members stacked in series with and/or parallel to each other. For example, the biasing member 306 may include a plurality of discs and/or washers (e.g., Belleville) springs in series with and/or parallel (e.g., a nested Belleville stack) to each other. As will be understood by one of ordinary skill in the art, the Belleville springs may be oriented relative to each other in series or parallel to achieve desired peak loads and desired displacement amplitudes. In some embodiments, the biasing member 306 may have a stiffness value within a range of about 4,000 lb/in flat load to about 40,000 lb/in flat load. For example, the biasing member 306 may have a stiffness value of about 10,000 lb/in flat load.

Referring to FIGS. 3-6 together, the cutting element assembly 300 may enable a cutting element 304 to be retained within the sleeve 302 and to be removable from the sleeve 302 without any heat application. For example, in operation, the cutting element 304 may be inserted into the sleeve 302 and sliding the retention element 339 and the cutting element 304 in an axial direction and into the cutter-receiving aperture 310. The cutting element 304 may be pressed into the cutter-receiving aperture 310 until the retention element 339 expands into the second portion 314. The retention element 339 may be disposed within the groove 338 and abut against the retaining face 340. The biasing member 306 may be compressed until the retention element 339 is inserted through the cutter-receiving aperture 310 completely past the retaining face 340 in an axial direction.

When the cutting element 304 is inserted into the sleeve 302 in the foregoing described manner, the retention element 339 may retain the cutting element 304 within the sleeve 302 via mechanical interference with the retaining face 340. Furthermore, the cutting element 304 is not prevented from rotating within the sleeve 302.

In one or more embodiments, the cutting element 304 may include one or more features that enable the cutting element 304 to be gripped (e.g., grasped) by a tool (e.g., a wrench) to apply torque to the cutting element 304. For example, the cutting element 304 may include one or more of a flat surface, a groove, a recess, textured surface, etc.

The rotatable and removable cutting element assemblies 300 as disclosed herein may have certain advantages over conventional fixed or restricted cutting elements. For example, sleeves 302 may be installed into a bit body (e.g., by brazing) before the cutting elements are installed into the sleeves. Thus, the cutting elements 304, and particularly the PDC tables, need not be exposed to the high temperatures typical of brazing. Thus, installing rotatable and removable cutting elements 304 into sleeves 302 already secured to a bit body may avoid thermal damage caused by brazing. Furthermore, cutting elements 304 as disclosed herein may be relatively easily removed and replaced, such as when the cutting elements 304 are worn or damaged. For instance, removal of a cutting element 304 from a sleeve 302 secured by the retention element 339 disclosed may be trivial in comparison to removal of cutting elements brazed into a bit body. For example, as discussed above, the cutting elements 304 depicted in FIGS. 3-6 may be removed by compressing the retention element 339 so that it may pass in an axial direction away from the inner base surface 342 and past the retaining face 340. Afterward, the cutting element 304 may be easily pulled out of the sleeve 302. Similarly, insertion of a new cutting element or the same cutting element 304 (e.g., a repaired cutting element) may be effected rapidly and without heating the drill bit. In view of the foregoing, the cutting element 304 may be rotated during operation of the drill string 118 without user intervention, fully removed, and/or replaced without heat. Thus, drill bits may have significantly longer lifespans and be more quickly repaired than drill bits having conventional cutting elements.

Figure 7:
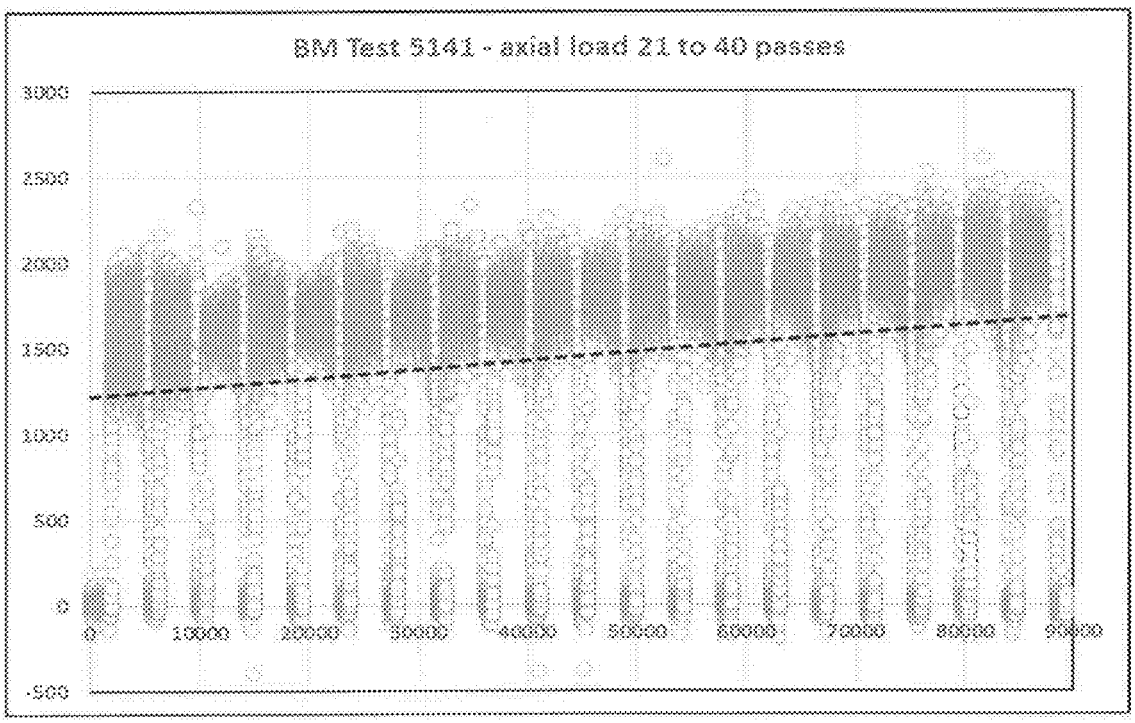
FIG. 7 is a graph that illustrates a relationship between axial load and time for a fixed cutting element.
Figure 8:
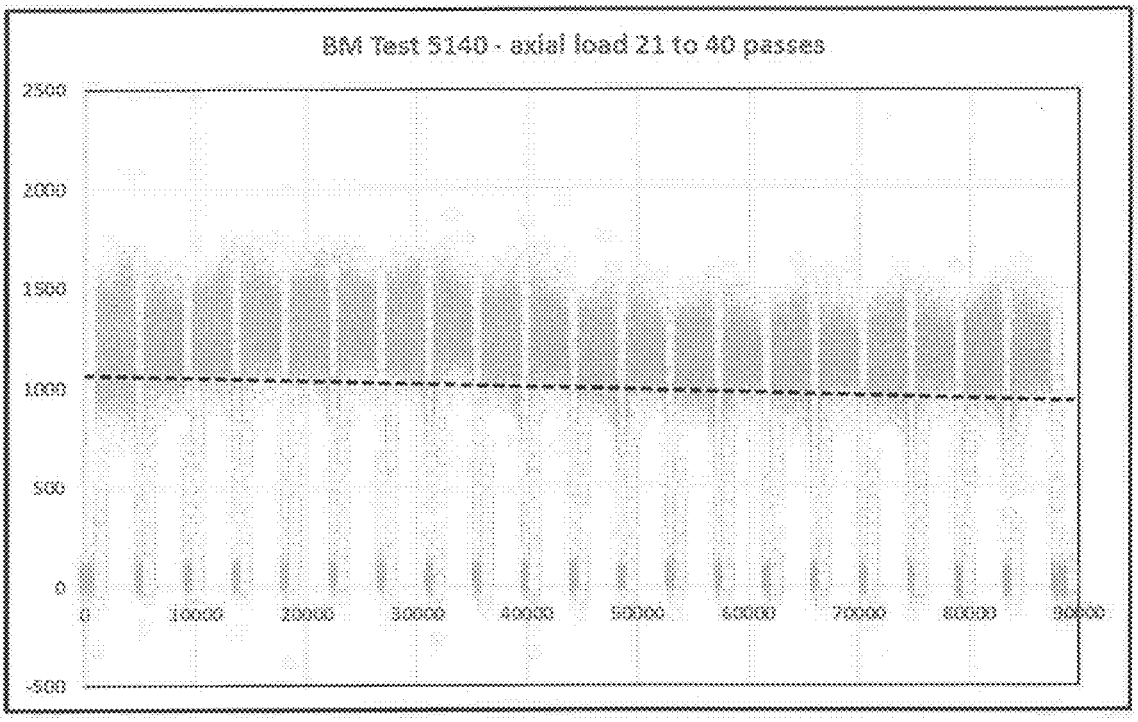
FIG. 8 is a graph that illustrates a relationship between axial load and time for a cutting element that is free to rotate.
Figure 9:
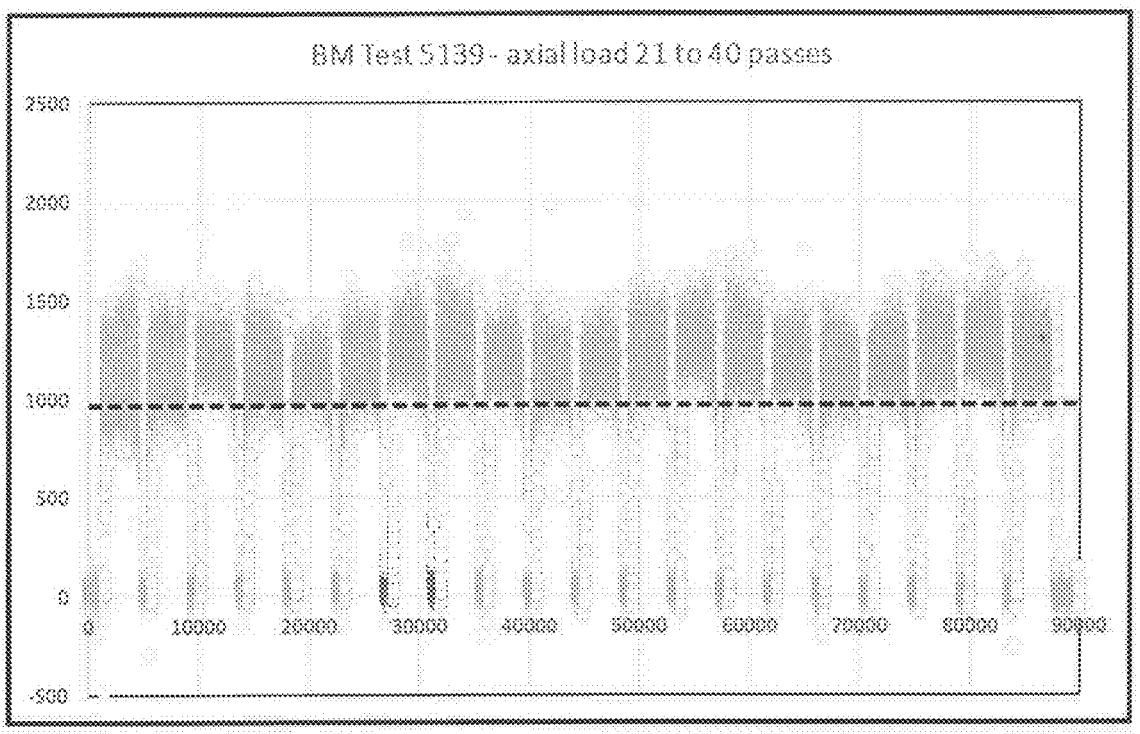
FIG. 9 is a graph that illustrates a relationship between axial load and time for a cutting element that is free to rotate and includes a biasing member.

FIGS. 7-9 depict graphs 700, 800, 900 representing data collected during the different testing scenarios performed by the inventor. For each graph, the axial load is depicted on the vertical, Y-axis, and time is on the horizontal, X-axis.

In particular, the graph 700 of FIG. 7 illustrates a relationship between axial load and time for a cutting element that is fixed relative to a respective sleeve. The increase in force required over time to maintain a depth of cut is evidence of the cutting element wearing down and creating a wear flat on a specific face of the cutting table. The wear as drilling continues creates a larger surface area of the wear flat and more friction when in operation which results in higher forces being required to maintain desired operating parameters of the drill bit. Additionally, a fixed cutting element may result in a shorter life span for the cutting element relative to the scenarios described below.

The graph 800 of FIG. 8 illustrates a relationship between axial load and time for a cutting element that is relatively free to rotate relative to a respective sleeve. The inconsistency in force required to maintain a depth of shows that the wear on the cutting face of the cutting element is inconsistent as no single location of the cutting face is subject to wear.

The graph 900 of FIG. 9 illustrates a relationship between axial load and time for a cutting element, as described in the present disclosure. For example, the cutting element represented in graph 900 is relatively free to rotate relative to a respective sleeve and includes a biasing member according to the embodiments described herein. The consistency in force required to maintain a depth of cut can be observed by the substantially horizontal trend line shown in FIG. 9. The cutting element being biased may help to aid in the cutting element being worn in an even manner while in operation. This may increase the effectiveness and the lifespan of the cutting element.

Embodiment 1: A cutting element assembly for a downhole tool, comprising: a cutting element; a sleeve having a cutter-receiving aperture extending at least partially through the sleeve configured to receive at least a portion of the cutting element; a retention element rotatably coupling the cutting element to the sleeve; and a biasing member disposed between the cutting element and the sleeve and configured to bias the cutting element relative to the sleeve in an axial direction.

Embodiment 2: The cutting element assembly of embodiment 1, wherein the cutting element comprises: a first cylindrical portion; a second cylindrical portion having a smaller diameter than the first cylindrical portion and extending from the first cylindrical portion, the second cylindrical portion sharing a center axis with the first cylindrical portion.

Embodiment 3: The cutting element assembly of embodiment 2, wherein the cutting element further comprises a groove in the second cylindrical portion of the cutting element extending circumferentially around the second cylindrical portion.

Embodiment 4: The cutting element assembly of embodiment 1-3, wherein the cutting element is configured to translate in the axial direction relative to the sleeve by a maximum distance within the range of about 0.001 to about 0.010 in.

Embodiment 5: The cutting element assembly of any of embodiments 1-4, wherein the biasing member is disposed between a longitudinal end of the cutting element opposite a cutting table of the cutting element and an inner base surface of the sleeve defining a bottom of the cutter-receiving aperture.

Embodiment 6: The cutting element assembly of any of embodiments 1-5, wherein the biasing member comprises a spring.

Embodiment 7: The cutting element assembly of any of embodiments 1-6, wherein the cutter-receiving aperture comprises: a first portion; a second portion having a larger diameter than the first portion and connected to the first portion, the second portion sharing a center longitudinal axis with the first portion.

Embodiment 8: The cutting element assembly of embodiment 7, wherein the retention element is configured to fit within the second portion of the cutter-receiving aperture and abut a retaining face of the sleeve at an interface of the first portion and the second portion of the cutter-receiving aperture.

Embodiment 9: The cutting element assembly of any of embodiments 1-8, wherein the retention element comprises a split ring.

Embodiment 10: The cutting element assembly of any of embodiments 1-9, wherein the cutting element being free to rotate relative to the sleeve about a longitudinal axis of the cutting element assembly.

Embodiment 11: A downhole tool, comprising: a body, at least one sleeve secured to the body and defining a cutter-receiving aperture, at least one cutting element disposed within the cutter-receiving aperture of the at least one sleeve, the at least one cutting element comprising: a first cylindrical portion, a second cylindrical portion having a smaller diameter than the first cylindrical portion and extending from the first cylindrical portion, the second cylindrical portion sharing a center longitudinal axis with the first cylindrical portion, a retention element rotatably coupling the at least one cutting element to the at least one sleeve and a biasing member configured to bias the at least one cutting element relative to the at least one sleeve in an axial direction.

Embodiment 12: The downhole tool of any of embodiments 1-11, wherein the at least one sleeve further comprises a chamfer along an inside edge of a receiving end of the at least one sleeve.

Embodiment 13: The downhole tool of any of embodiments 2, 11, or 12, wherein an outer diameter of the second cylindrical portion of the at least one cutting element is substantially the same as a diameter of a first portion of the cutter-receiving aperture.

Embodiment 14: The downhole tool of any of embodiments 1-13, wherein the biasing member comprises at least one Belleville spring.

Embodiment 15: The downhole tool of any of embodiments 1-14 wherein the at least one cutting element comprises a polycrystalline hard material.

Embodiment 16: The downhole tool of any of embodiments 1-15, wherein the at least one cutting element further comprises a chamfer along a cutting edge of a cutting face of the first cylindrical portion.

Embodiment 17: The downhole tool of any of embodiments 2 or 11-13, wherein the retention element is disposed within a groove in the second cylindrical portion of the at least one cutting element extending circumferentially around the second cylindrical portion.

Embodiment 18: A method of forming a downhole tool, comprising: forming a bit body including at least one blade extending from the bit body; securing at least one sleeve to the at least one blade, the at least one sleeve defining a cutter-receiving aperture: disposing at least one biasing member within the cutter-receiving aperture; and inserting a cutting element into the cutter-receiving aperture of the at least one sleeve, such that the at least one biasing member is disposed between the at least one sleeve and the cutting element and biases the cutting element relative to the at least one sleeve in an axial direction.

Embodiment 19: The method of embodiment 18, further comprising retaining the cutting element within the at least one sleeve via a retention element.

Embodiment 20: The method of embodiment 18 or 19, wherein inserting a cutting element into the cutter-receiving aperture of the at least one sleeve comprises inserting the cutting element such that the at least one biasing member is disposed between a longitudinal end of the cutting element and an inner base surface of the at least one sleeve defining a bottom of the cutter-receiving aperture.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as claimed, including legal equivalents thereof. In addition, features from one embodiment may be combined with features of another embodiment while still being encompassed within the scope of the invention as contemplated by the inventors. Further, embodiments of the disclosure have utility with different and various tool types and configurations.

What is claimed is:

1. A cutting element assembly for a downhole tool, comprising:

a cutting element;

a sleeve having a cutter-receiving aperture extending at least partially through the sleeve and configured to receive at least a portion of the cutting element;

a retention element rotatably coupling the cutting element to the sleeve; and a biasing member disposed between the cutting element and the sleeve and configured to bias the cutting element relative to the sleeve in an axial direction, wherein the cutting element is configured to translate in the axial direction relative to the sleeve by a maximum distance within a range of about 0.001 to about 0.010 in.

2. The cutting element assembly of claim 1, wherein the cutting element comprises:

a first cylindrical portion; and a second cylindrical portion having a smaller diameter than the first cylindrical portion and extending from the first cylindrical portion, the second cylindrical portion sharing a center axis with the first cylindrical portion.

3. The cutting element assembly of claim 2, wherein the cutting element further comprises a groove in the second cylindrical portion of the cutting element extending circumferentially around the second cylindrical portion.

4. The cutting element assembly of claim 1, wherein the biasing member is disposed between a longitudinal end of the cutting element opposite a cutting table of the cutting element and an inner base surface of the sleeve defining a bottom of the cutter-receiving aperture.

5. The cutting element assembly of claim 4, wherein the biasing member comprises a spring.

6. The cutting element assembly of claim 1, wherein the gutter-receiving aperture comprises:

a first portion; and a second portion having a larger diameter than the first portion and connected to the first portion, the second portion sharing a center longitudinal axis with the first portion.

7. The cutting element assembly of claim 6, wherein the retention element is configured to fit within the second portion of the cutter-receiving aperture and abut a retaining face of the sleeve at an interface of the first portion and the second portion of the cutter-receiving aperture.

8. The cutting element assembly of claim 1, wherein the retention element comprises a split ring.

9. The cutting element assembly of claim 1, the cutting element being free to rotate relative to the sleeve about a longitudinal axis of the cutting element assembly.

10. A downhole tool, comprising:

a body;

at least one sleeve secured to the body and defining a cutter-receiving aperture;

at least one cutting element disposed within the cutter-receiving aperture of the at least one sleeve, the at least one cutting element comprising:

a first cylindrical portion;

a second cylindrical portion having a smaller diameter than the first cylindrical portion and extending from the first cylindrical portion, the second cylindrical portion sharing a center longitudinal axis with the first cylindrical portion;

a retention element rotatably coupling the at least one cutting element to the at least one sleeve; and a biasing member configured to bias the at least one cutting element relative to the at least one sleeve in an axial direction, wherein the cutting element is configured to translate in the axial direction relative to the sleeve by a maximum distance within a range of about 0.001 to about 0.010 in.

11. The downhole tool of claim 10, wherein the at least one sleeve further comprises a chamfer along an inside edge of a receiving end of the at least one sleeve.

12. The downhole tool of claim 10, wherein an outer diameter of the second cylindrical portion of the at least one cutting element is substantially the same as a diameter of a first portion of the cutter-receiving aperture.

13. The downhole tool of claim 10, wherein the biasing member comprises at least one Belleville spring.

14. The downhole tool of claim 10 wherein the at least one cutting element comprises a polycrystalline hard material.

15. The downhole tool of claim 10, wherein the at least one cutting element further comprises a chamfer along a cutting edge of a cutting face of the first cylindrical portion.

16. The downhole tool of claim 10, wherein the retention element is disposed within a groove in the second cylindrical portion of the at least one cutting element extending circumferentially around the second cylindrical portion.

17. A method of forming a downhole tool, comprising:

forming a bit body including at least one blade extending from the bit body;

securing at least one sleeve to the at least one blade, the at least one sleeve defining a cutter-receiving aperture;

disposing at least one biasing member within the cutter-receiving aperture; and inserting a cutting element into the cutter-receiving aperture of the at least one sleeve, such that the at least one biasing member is disposed between the at least one sleeve and the cutting element and biases the cutting element relative to the at least one sleeve in an axial direction, and wherein the cutting element is configured to translate in the axial direction relative to the sleeve by a maximum distance within a range of about 0.001 to about 0.010 in.

18. The method of claim 17, further comprising retaining the cutting element within the at least one sleeve via a retention element.

19. The method of claim 17, wherein inserting a cutting element into the cutter-receiving aperture of the at least one sleeve comprises inserting the cutting element such that the at least one biasing member is disposed between a longitudinal end of the cutting element and an inner base surface of the at least one sleeve defining a bottom of the cutter-receiving aperture.

* * * * *